US006499266B1

(12) United States Patent
Macumber

(10) Patent No.: US 6,499,266 B1
(45) Date of Patent: Dec. 31, 2002

(54) TRUSS CONSTRUCTION

(75) Inventor: Kirk Macumber, Winterset, IA (US)

(73) Assignee: Lemar Industries Corp., Des Moines, IA (US)

( * ) Notice: Subject to any disclaimer, the term of this patent is extended or adjusted under 35 U.S.C. 154(b) by 0 days.

(21) Appl. No.: 09/970,131

(22) Filed: Oct. 3, 2001

Related U.S. Application Data

(60) Provisional application No. 60/305,683, filed on Jul. 16, 2001.

(51) Int. Cl.[7] ..... E04H 12/18

(52) U.S. Cl. ..... 52/694; 52/646; 52/632; 52/645; 52/695

(58) Field of Search ..... 52/645, 632, 640, 52/695, 646, 694

(56) References Cited

U.S. PATENT DOCUMENTS 2,067,709 A * 1/1937 Humphrey ..... 52/651.06
2,681,834 A * 6/1954 Benson et al. ..... 24/701
3,193,060 A * 7/1965 Park ..... 211/182
D227,086 S * 6/1973 Johnson ..... D13/1 H
4,578,919 A * 4/1986 Amadon et al. ..... 52/108
4,745,724 A * 5/1988 Reetz ..... 52/632
4,957,186 A * 9/1990 Reetz ..... 248/284.1
RE34,103 E * 10/1992 Mabey et al. ..... 52/645
6,047,504 A * 4/2000 Dusenberry ..... 52/514

* cited by examiner

*Primary Examiner*—Carl D. Friedman
*Assistant Examiner*—Basil Katcheves
(74) *Attorney, Agent, or Firm*—McKee, Voorhees & Sease, P.L.C.

(57) ABSTRACT

A truss assembly includes angled cross members and straight cross members which extend between two parallel truss members. Brackets are provided along the two parallel truss members for attachment to the ends of the angled and straight truss members. Slots are provided either in the brackets or in the angled truss members to permit pivotal movement of the angled truss members to accommodate varying dimensions of the truss assembly.

9 Claims, 4 Drawing Sheets

TRUSS CONSTRUCTION

CROSS-REFERENCE TO RELATED APPLICATIONS

This application claims the benefit of Provisional Application No. 60/305,683 filed Jul. 16, 2001.

BACKGROUND OF THE INVENTION

This invention relates to a truss construction.

In the construction of trusses various angle trusses extend between two parallel truss members, and are attached to the parallel truss members. Usually brackets are provided for attaching the angled truss members to the parallel truss members. Matching bolt holes in the ends of the angled truss members and in the brackets, are used to bolt the truss members to the brackets and thus create the truss assembly.

The problem encountered with presently known truss assemblies is the requirement that different brackets be used for truss assemblies that have different longitudinal dimensions or different dimensions between the two parallel truss members. So it is necessary to manufacture different brackets for each different dimension of truss assembly.

Therefore, a primary object of the present invention is the provision of an improved truss construction.

A further object of the present invention is the provision of an improved truss construction which requires only one set of brackets which can be universally used for truss assemblies having different dimensions.

A further object of the present invention is the provision of an improved truss assembly which permits the angle of the trusses to be pivoted to accommodate varying dimensions.

A further object of the present invention is the provision of an improved truss assembly which is economical to manufacturer, durable in use, and efficient in operation.

BRIEF SUMMARY OF THE INVENTION

The foregoing objects can be achieved with a truss assembly having first and second elongated parallel truss members. A plurality of brackets are fixed to the first and second truss members in spaced apart relation to one another. Each of the brackets includes first, second and third pairs of bracket holes therein, each of the pairs of bracket holes comprising an end bracket hole and a second bracket hole. A plurality of first angled truss members, second angled truss members and straight truss members each have opposite ends. The opposite ends of each of these truss members being provided with an end truss hole and a second truss hole. Each of the first angled truss members, the second angled truss members and the straight truss members extending between the first and second elongated parallel truss members. A first end bolt extends through the truss end hole of one of the first angled trusses and through the bracket end hole of the first pair of bracket holes. A second bolt extends through the truss second hold of the first angled truss member and through the bracket second hole of the first pair of bracket holes.

A third bolt extends through the truss end hole of one of the second angled trusses and through the bracket end hole of the second pair of bracket holes. A fourth bolt extends through the second truss hole of the second angled truss and through the second bracket hole of the second pair of bracket holes. A fifth bolt extends through the end truss hole of one of the straight truss members and through the end bracket hole of the third pair of bracket holes. A sixth bolt extends through the second truss hole of the one straight truss member and through the second bracket hole of the third pair of bracket holes. One of the second truss hole of the first angled truss and the second bracket hole of the first pair of bracket holes is an elongated curved slot. One of the second truss hole of the second angled truss and the second bracket hole of the second pair of bracket holes is an elongated curved slot.

It is possible to form the slot either in the bracket or in the angled truss member with the same result. Nuts are threaded upon the six bolts for tightening them to attach the first and second angled truss members and the straight truss member to the one bracket.

This permits the first and second angled truss members to be pivoted to accommodate varying dimensions of length of the truss assembly and/or various widths between the two parallel truss members.

DETAILED DESCRIPTION OF THE INVENTION

Figure 1:
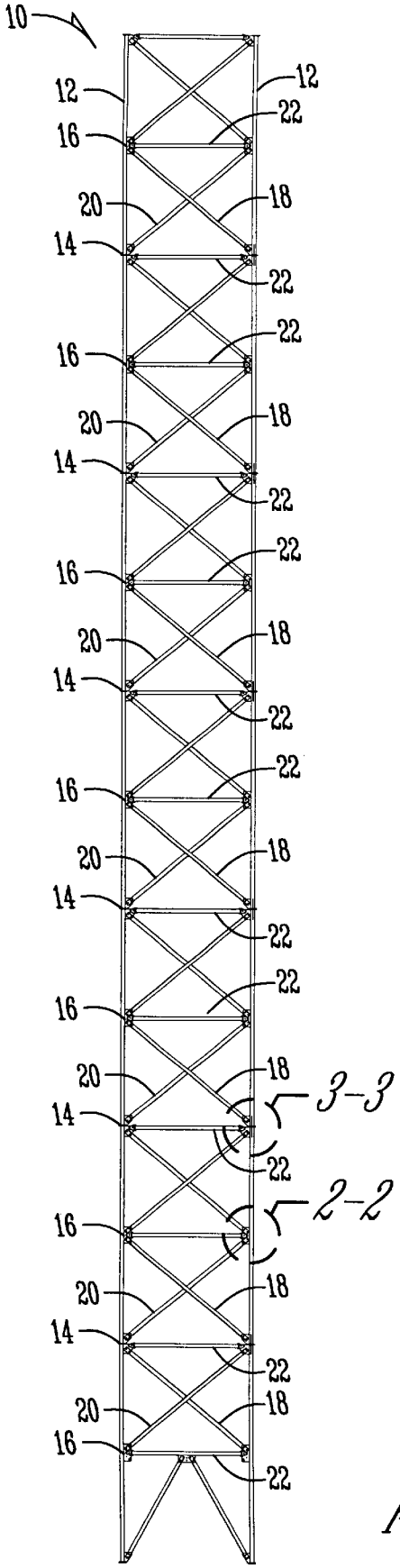
FIG. 1 is an elevational view of a square truss construction.
Figure 1A:
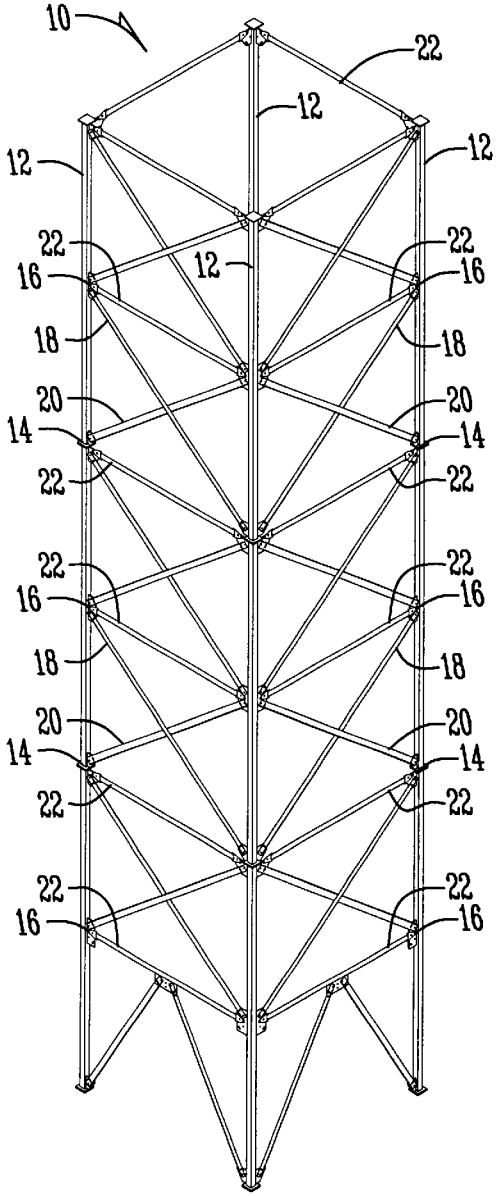
FIG. 1A is a pictorial view of a portion of the square truss construction shown in FIG. 1.

FIGS. 1 and 1A show the truss assembly 10. Truss assembly 10 comprises four vertical members 12 arranged in a square configuration. The four members 12 each comprise an assembly made from various spliced configurations to be described in more detail hereafter. A plurality of splice joints 14 (shown in pictorial view in FIG. 6) are provided approximately every 20 feet (see FIGS. 1 and 6). Between each pair of splice joints 14 is an intermediate joint 16. A first angle member 18 and a second angle member 20 are formed into an X and have their opposite ends connected to the spliced joints 14 or the intermediate joints 16. In FIG. 1A only the front two sides are shown with cross truss members for the purpose of clarity, but all four sides include the angle members 18, 20, and the straight members 22 as shown in FIG. 1.

Figure 2:
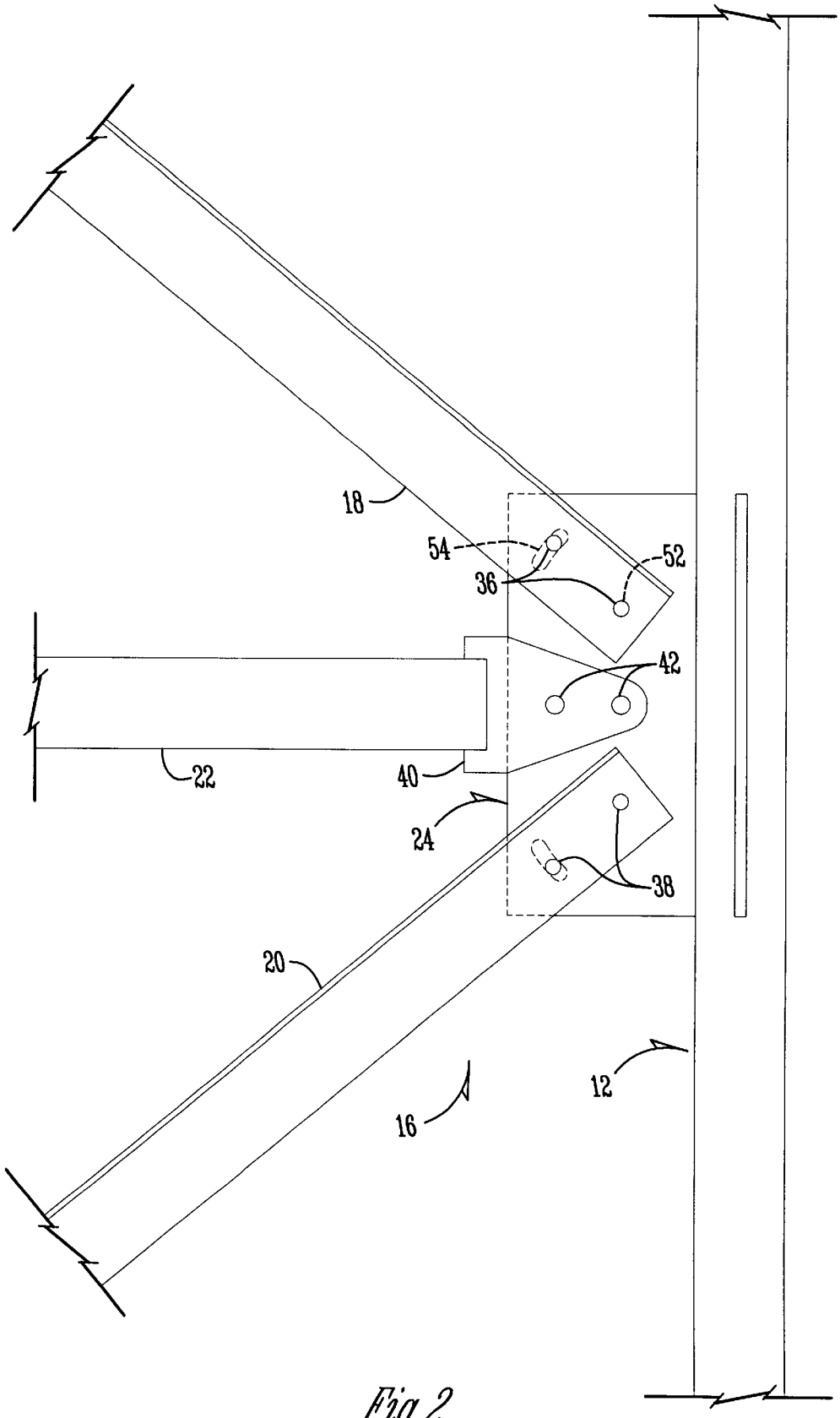
FIG. 2 is an enlarged view taken along 2—2 of FIG. 1.
Figure 4:
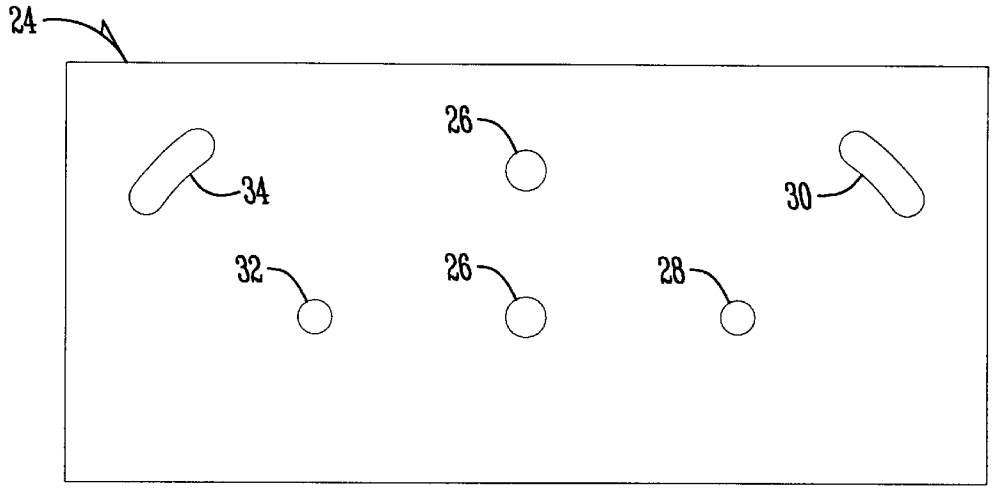
FIG. 4 is a plan view of one of the truss plates of the present invention.

FIG. 2 illustrates an intermediate joint 16. It comprises the vertical member 12 to which is welded a middle bracket 24. Middle bracket 24 is shown in FIG. 4 to be rectangular in configuration and to include a pair of straight truss member holes 26, a first angle hole 28, a first angle curved slot 30, a second angle end hole 32 and a second angle curved slot 34.

Referring again to FIG. 2 the first angle 18 includes a pair of spaced apart end holes 36. One of the end holes 36 is registered with the end hole 28 of bracket member 24. The other end hole 36 is registered above the arcuate slot 30 in the middle bracket 24. Use of the angular slot 30 permits angle member 18 to be pivoted to accommodate varying lengths of truss assemblies. Thus the sections of the assembly can be formed 20 feet apart, or other dimensions apart and the angle of the angle member 18 can be adjusted accordingly.

Similarly, the second angle member 20 includes a pair of end angle holes 38 which are registered over hole 32 and slot 34 and secured in the same manner.

Figure 5:
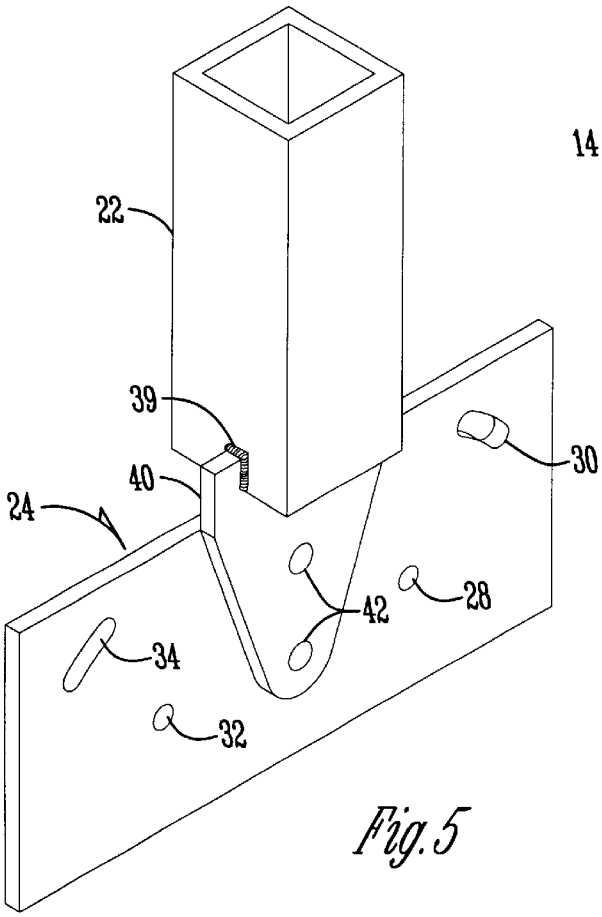
FIG. 5 is a pictorial view of the straight member attached to the truss plate of the present invention.

The straight truss member 22 is preferably of a tubular construction and is welded to a straight truss plate 40 along a weld joint 39 in the manner shown in FIG. 5. Plate 40 includes a pair of bolt holes 42 which are registered with the straight member holes 26 in the bracket 24.

Figure 3:
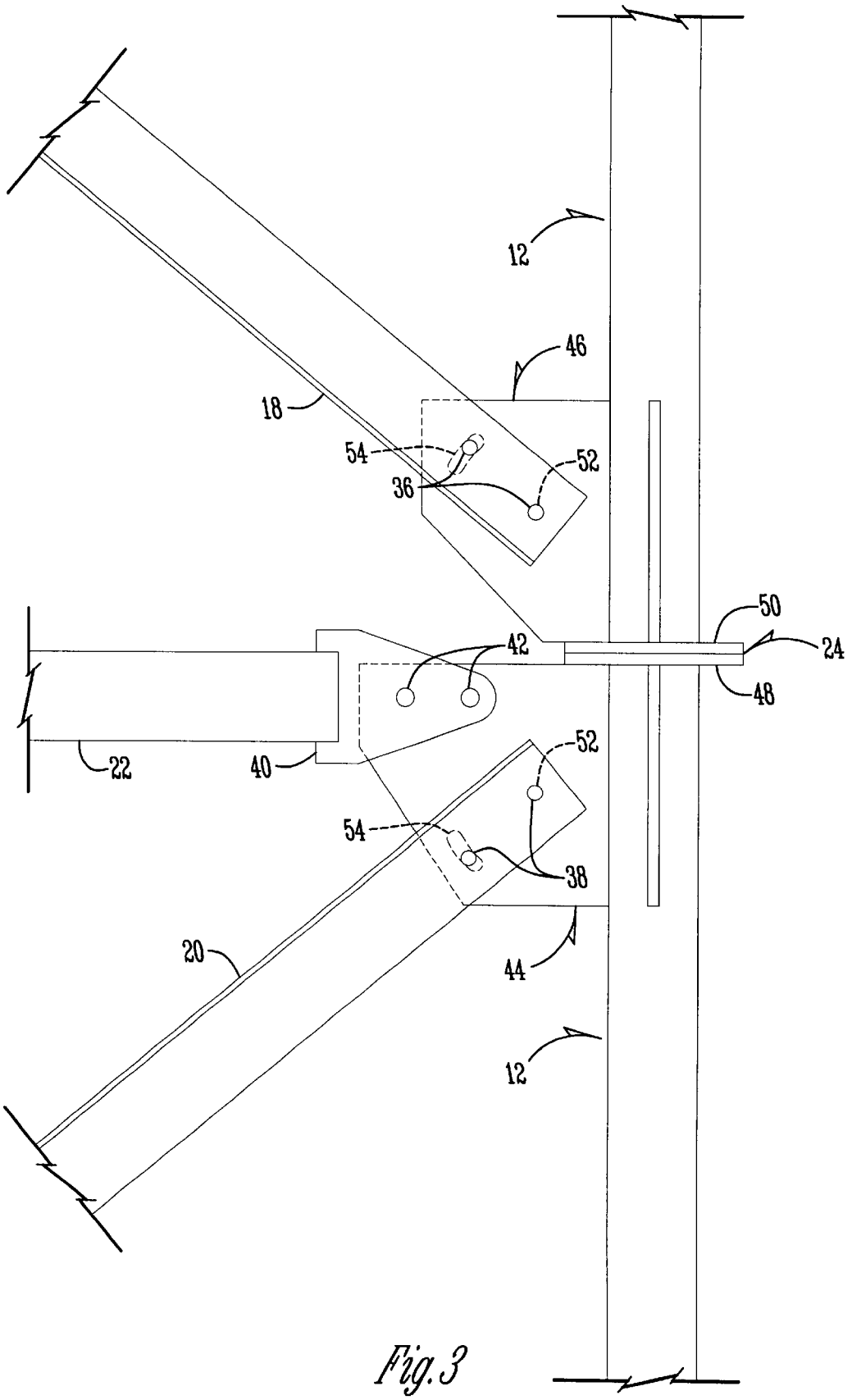
FIG. 3 is an enlarged view taken along 3—3 of FIG. 1.

FIG. 3 illustrates the use of splice brackets 44, 46 which are mounted at the splice joint 24. A pair of splice plates 48, 50 are mounted in facing relation to one another and are bolted together to create the splice joint. The bolts are not shown in the drawings in order to show the registered holes and slots of plates 24, 44, 46 and truss members 18, 20, 22 more clearly. The brackets 44, 46 are each provided with an end hole 52 and a curved slot 54 which are registered with the end holds 36, 38 of angles 18, 20

Figure 6:
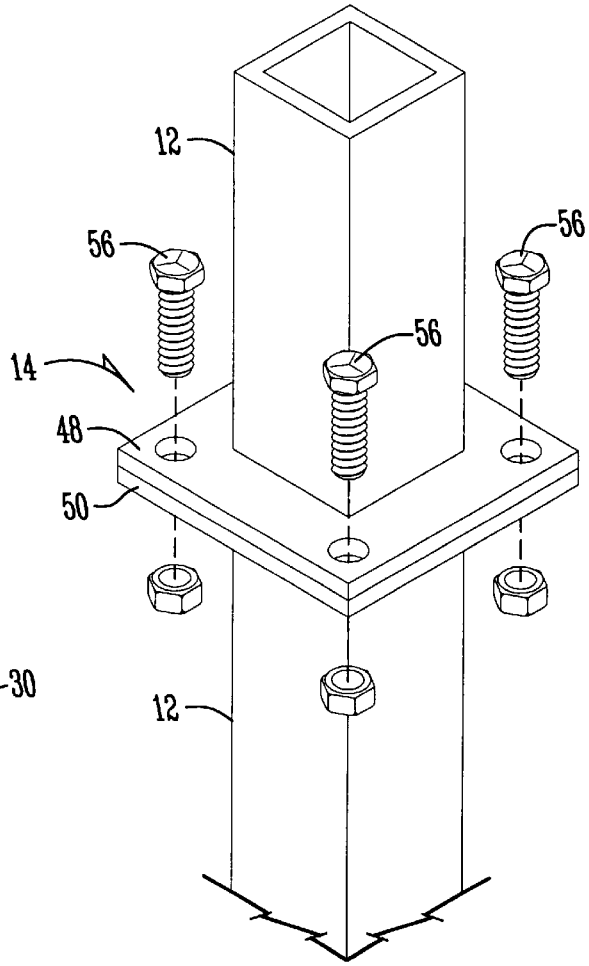
FIG. 6 is a pictorial view of a splice between two vertical members of the truss assembly.

FIG. 6 shows the manner in which the splice joint 14 is assembled. Bolts 56 extending through bolt holes 58 are used to secure the splice plates 48, 50 together.

The advantage of the present invention is that the use of the arcuate slots 30 in the intermediate plate 24 and the arcuate slots 54 in the two end brackets 44, 46 permit a universal assembly for assembling truss assemblies of different dimensions. The plates 24, 44 and 46 can be welded to the vertical corner members 12, and various sized truss assemblies can be constructed merely by rotating the angle members 18, 20 to accommodate the varying dimensions. The arcuate slots permit this variation in angle of the angle members 18, 20. Using these slotted adapter plates 24, 44, 46 requires only one set of plates for trusses of various dimensions. In prior truss assemblies without the slots 30, 34 and 54, different plates were required for each truss having a different longitudinal dimension.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A truss assembly comprising first and second elongated parallel truss members;

a plurality of spaced apart brackets fixed to said first and second truss members, each of said brackets having a first end hole, a first curved slot having a curved longitudinal axis, a second end hole, a second curved slot having a curved longitudinal axis, and a pair of straight member holes;

a plurality of first angled truss members having opposite ends and having a longitudinal axis perpendicular to the curved longitudinal axis of the first curved slot, each provided with first and second bolt holes, said first angled truss members extending between said parallel truss members at a first angle with respect thereto;

a plurality of second angled truss members having opposite ends and having a longitudinal axis perpendicular to the curved longitudinal axis of the second curved slot, each provided with first and second bolt holes, said second angled truss members each crossing one of said first angled truss members and extending between said first and second parallel truss members at a second angle different from said first angle with respect thereto;

a plurality of straight truss members having opposite ends each provided with first and second bolt holes, each of said straight truss members extending between said first and second parallel truss members at a third angle perpendicular thereto;

each of said brackets having said first end hole and said first curved slot registered with said first and second bolt holes in one of said opposite ends of one of said first angled truss members and adapted to receive various sized truss members;

a first pair of bolts, each of which extends through one of said registered holes and slots of said first angled member and said bracket to attach said first angled truss member to said bracket member;

each of said brackets having said second end hole and said second curved slot registered with said first and second bolt holes in one of said opposite ends of one of said second angled truss members;

a second pair of bolts, each of which extends through one of said registered holes and slots of said second angled member and said bracket to attach said second angled truss member to said bracket;

each of said bracket members having said first and second straight member holes registered with one of said pairs of bolt holes in one of said straight truss members;

a third pair of bolts, each of which extends through said registered holes of said bracket and said one straight truss member to attach said straight truss to said bracket.

2. A truss assembly according to claim one wherein at least some of said brackets each comprise a single unitary plate.

3. A truss assembly according to claim 1 wherein at least some of said brackets each comprise two or more separate plates.

4. A truss assembly according to claim 1 wherein a first group of said brackets each comprises a single unitary plate and a second group of said brackets each comprise two or more separate plates.

5. A truss assembly comprising:

first and second elongated parallel truss members;

a plurality of brackets fixed to said first and second truss members in spaced apart relation to one another;

each of said brackets having a first end hole, a first curved slot, a second end hole, a second curved slot, a first straight member hole, and a second straight member hole;

a plurality of first angled truss members, second angled truss members and straight truss members, each having opposite ends, each of said opposite ends being provided with an end hole and a second hole;

each of said first angled truss members, said second angled truss members, and said straight truss members extending between said first and second elongated parallel truss members;

first and second bolts attaching each one of said opposite ends of one of said first angled truss members to one of said brackets, said first bolt extending through said first end hole of said one bracket and through said end hole of said one first angled truss member, said second bolt extending through said first curved slot of said one bracket and through said second hole of said one first angled truss member;

third and fourth bolts attaching each one of said opposite ends of one of said second angled truss members to one of said brackets, said third bolt extending through said second end hole of said one bracket and through said end hole of said one second angled truss member, said fourth bolt extending through said second curved slot of said one bracket and said second hole of said one second angled truss member;

fifth and sixth bolts attaching each one of said opposite ends of one of said straight angled truss members to one of said brackets, said fifth bolt extending through said first straight member hole of said one bracket and said end bolt hole of said one straight truss member, said sixth bolt extending through said second straight member hole of said one bracket and said adjustment bolt hole of said one straight truss member.

6. A truss assembly according to claim 5 wherein said first and second angled truss members are each pivotal about said first and third bolts respectively and said third and fourth bolts are movable within said first and second curved slots respectively of said bracket for permitting said pivotal movement of said first and second angled members respectively.

7. A truss assembly comprising:

first and second elongated parallel truss members;

a plurality of brackets fixed to said first and second truss members in spaced apart relation to one another;

each of said brackets having a first, second and third pairs of bracket holes therein, each of said pairs of bracket holes comprising an end bracket hole and a second bracket hole;

a plurality of first angled truss members, second angled truss members and straight truss members, each having opposite ends, each of said opposite ends being provided with an end truss hole and a second truss hole;

each of said first angled truss members, said second angled truss members, and said straight truss members extending between said first and second elongated parallel truss members;

a first end bolt extending through said truss end hole of one of said first angled trusses and through said bracket end hole of said first pair of bracket holes;

a second bolt extending through said truss second hole of said one first angled truss member, and through said bracket second hole of said first pair of bracket holes;

a third bolt extending through said truss end hole of one of said second angled trusses and through said bracket end hole of said second pair of bracket holes;

a fourth bolt extending through said second truss hole of said second angled truss and through said second bracket hole of said second pair of bracket holes;

a fifth bolt extending through said end truss hole of one of said straight truss members and through said end bracket hole of said third pair of bracket holes;

a sixth bolt extending through said second truss hole of said one straight truss member and through said second bracket hole of said third pair of bracket holes;

one of said second truss hole of said first angled truss and said second bracket hole of said first pair of bracket holes being an elongated curved slot;

one of said second truss hole of said second angled truss and said second bracket hole of said second pair of bracket holes being an elongated curved slot.

8. A truss assembly according to claim 7 and further comprising six nuts, each of which is threaded upon one of said first through said sixth bolts for tightening to attach said first and second angled truss members and said straight truss member to said one bracket.

9. A truss assembly according to claim 8 wherein said first and second angled truss members are pivotal about said first and third bolts, respectively before said tightening of said six nuts, said second and said fourth bolts being movable within said elongated curved slots of said bracket during said pivotal movement.

* * * * *